US006154905A

United States Patent [19]

Frydman

[11] Patent Number: 6,154,905

[45] Date of Patent: Dec. 5, 2000

[54] ORTHOPEDIC SUPPORT PILLOW

[76] Inventor: Larry G. Frydman, 195 Charles Street, Thornhill, Ontario, Canada, L4J 3A2

[21] Appl. No.: 09/353,416

[22] Filed: Jul. 15, 1999

Related U.S. Application Data

[63] Continuation-in-part of application No. 08/999,372, Dec. 29, 1997, abandoned, which is a continuation of application No. 08/480,581, Jun. 7, 1995, abandoned.

[51] Int. Cl.[7] ..... A47C 20/02

[52] U.S. Cl. ..... 5/648; 5/650; 128/845; 128/882; 606/240

[58] Field of Search ..... 5/630, 632, 636, 5/646, 648, 651, 652, 464, 650; 128/845, 882, 891, 892, 240; 606/240

[56] References Cited

U.S. PATENT DOCUMENTS

| | | |
|---|---|---|
| D. 319,751 | 9/1991 | Hoff . |
| D. 321,562 | 11/1991 | Ljiungvall . |
| 3,604,023 | 9/1971 | Lynch . |
| 4,371,985 | 2/1983 | Pokhis . |
| 4,392,489 | 7/1983 | Wagner . |
| 4,550,459 | 11/1985 | Endel . |
| 4,584,730 | 4/1986 | Rajan . |
| 4,624,021 | 11/1986 | Hofstetter . |
| 4,706,302 | 11/1987 | Padfield . |
| 4,736,477 | 4/1988 | Moore . |
| 4,805,605 | 2/1989 | Glassman . |
| 4,821,355 | 4/1989 | Burkhardt . |
| 4,910,818 | 3/1990 | Grabill . |
| 5,097,551 | 3/1992 | Smith . |
| 5,097,553 | 3/1992 | Boland . |
| 5,113,875 | 5/1992 | Bennett . |
| 5,125,123 | 6/1992 | Engle . |
| 5,216,771 | 6/1993 | Hoff . |
| 5,289,828 | 3/1994 | Toth . |
| 5,477,866 | 12/1995 | Davenport . |
| 5,746,218 | 5/1998 | Edge . |

*Primary Examiner*—Flemming Saether
*Attorney, Agent, or Firm*—Small Larkin, LLP

[57] ABSTRACT

A stress reducing device is defined by a dual use orthopedic pillow having a low density polyurethane foam outer region, a high density polyurethane foam middle region that are provided in removably attachable layers, so that the size of the device may be adjusted to accommodate different sizes and preferences of individual users. The pillow advantageously includes leg clasps for securely engaging the inner thighs of an individual in a sideling position defined by a stem and a pair of crescent shaped buttresses. The buttresses resist rotation to the prone and supine lying positions. The high foam within the stem separates the knees to reduce spinal stress. Advantageously, a supine sleeping position is added by positioning said pillow under the legs to flatten out the spine while supporting the legs at the thigh and calf regions.

2 Claims, 3 Drawing Sheets

ORTHOPEDIC SUPPORT PILLOW

This is a continuation-in-part of application Ser. No. 08/999,372, filed Dec. 29, 1997, now abandoned, which was a continuation of application Ser. No. 08/480,581, filed Jun. 7, 1995, now abandoned.

BACKGROUND OF THE INVENTION

A. Field of the Invention

The present invention relates to orthopedic support devices for minimizing spinal stress while an individual is in the lying position. More particularly the present invention relates to an orthopedic support device that bolsters, i.e., supports the back of the legs of an individual lying on his/her back and additionally maintains spinal support for an individual when lying on his/her side; and to adjustable orthopedic support pillows which can be varied and customized to support the individual's needs.

B. Discussion of the Prior Art

Spinal related complaints are very common. In fact, back pain is the second most common complaint (behind the common cold) for visits to the family doctor. Proper spinal support (whether related to the lower back, upper back or neck) has been a concern for decades. This has resulted in a significant variety of products designed to provide greater comfort and support.

The majority of these products were designed for 95 percentile of the population. As all individuals vary anatomically, and when combining this factor with individual and personal preference, the varying possibilities would render customization to all individuals to be not practical. Methods of customization for both the cervical and lumbar spine have been attempted, as discussed below. However, these vary from intricate systems of support that are either adjustable through an inflatable means, fluid filled or even a combination of self attachment through the use of hook and loop fastening devices, zippers and strapping. All of these methods although effective, would be extremely costly from a manufacturing standpoint. None of these products, whether designed to support the cervical or lumbar spine, ever considered the specific needs of the individual user. For all of the above reasons, a need exists for an orthopedic support pillow that is capable of being customized to the individuals needs as opposed to the individual conforming to the product.

The present invention overcomes many of the problems of the prior art in that it provides a capability for customization of an orthopedic support pillow to fit the individuals needs, without the use of accessory application devices such as hook and loop, elastic bands, zippers and/or straps.

It is generally known that maintaining proper posture of the spine helps to prevent the occurrence of spinal injury and back pain. The preferred proper spinal posture in all daily sitting and upright activities includes a slight lordotic curve in the lumbar region of the spine, or what is known as the "neutral spine" position in lay terms. That is the spinal position where all stress on the spine is minimized to allow the spine to rest in its naturally curved position. For example, it is commonly known that when lifting heavy objects, an individual should use their knees to lift such objects and that the back should be maintained in the neutral spine position to alleviate any potential stress to the spine which can lead to back pain.

With the recent, increasing interest in ergonomics and in prevention of repetitive trauma injuries in the work place, sleep ergonomics has been for the most part neglected. On the average of ⅓ of most individuals' lives is spent partaking in this form of activity. One must appreciate the necessity that merely lying down is not sufficient for spinal stress reduction and thus proper sleep postural maintenance is paramount for complete and comfortable rest.

For years it has been recommended that proper sleep posture would entail avoiding the prone position, simply due to the aggravated stress on the lumbar spine (from accentuation of the lordotic curve) and as well the rotational positioning of the cervical spine could lead to neck pathomechanics over time. The supine position was promoted, however, without the appropriate flexion at the knee the lumbar lordotic curve was as well accentuated. In other words, when lying on the backside, it is natural for the legs to lie flat on the sleeping surface. In this manner the legs cooperate with the buttocks to act as a lever raising the lumbar region of the spine thereby causing an unnatural accentuation of the lordotic curve that may result in stress on the spine as well. In order to alleviate this stress caused by the legs, it is preferred that an individual sleep with the knees bent. This sleeping position reduces the stress on the lumbar region of the spine and allows the spine to rest flatly against the mattress or other sleeping surface. However, without some type of leg support, the natural tendency of the knees is to flatten out.

Lying on one's side is another preferred sleep position. However, without the appropriate support, the lumbar spine has a tendency to be affected by rotational stresses due to torquing factors between the upper and lower body. In the side lying position, the legs of the individual are generally maintained in an overlying relationship with each other. Positioning the legs in this manner at the mattress along one side of the body causes the body to compensate for this position which may result in stress on the spine. In order to minimize these stresses one must be knowledgeable of both human anatomy as well as physical forces acting on the spine. Simply relieving gravitational stress from the spine is insufficient to reduce spinal stress and strain to the point of eliminating it.

Several devices have been proposed to alleviate stress on the spine of an individual while sleeping. Such devices include large pillows or other supporting devices placed between the upper thighs of an individual to maintain a side lying position. These pillows extend out and away from the front and back sides of the individual to block, or prevent the individual from rolling over. Such devices are well known in the art and a variety of such pillows are available. One problem associated with these devices arises from the natural tendency of people to roll or shift positions while sleeping. Such movement can cause these pillows to shift or move from the preferred position in-between the individuals legs thereby defeating the purpose of the pillow or causing the sleeper to awaken and re-adjust the pillow. Some side lying devices have over come this problem by adding straps to secure the pillow to the thighs. However, it is not desirable to secure the pillow in this manner especially if a fire or other emergency occurred. Thus the need exists for an orthopedic support pillow that maintains support between the legs for a sleeper lying in a side lying position, but which can easily be removed.

In addition, it is desirable to have an orthopedic device as described above that could also support the back sides of the legs to maintain a bend in the knees of an individual while lying in the supine position. Such a dual capability would allow an individual to select a comfortable sleeping position while helping to alleviate stress on the spine. Thus the need exists for an orthopedic device that relieves spinal stress and strain either when an individual is lying on his/her side or back, and provides for a selection of individual sleep positions.

OBJECTS AND SUMMARY OF THE INVENTION

A primary object of the present invention is provide a flexible lower limb support device which can be utilized in order to support and assist an individual to lying in either the supine or side lying positions.

It is yet another object of the present invention to provide a flexible lower limb support device which will inhibit an individual from lying in the prone position.

It is yet another object of the present invention to provide a flexible lower limb support device which can maintain the normal anatomical position of the lower limbs when side lying in order to minimize stress on the lumbar spine, sacroiliac joints and femoral acetabular joints.

It is yet another object of the present invention to provide a flexible lower limb support device which will assist an individual lying supine by minimizing the lumbar lordotic curve.

Another object of the present invention is to provide leg secure engagement of the device to the inner thighs of the individual for uninterrupted sleep while in a side lying position.

These and other objects of the present invention are attained by providing lower limb support device which is, generally, biconcave in lengthwise design and consists of two outer layers of lower density polyurethane foam and a middle layer of higher density polyurethane foam. The opposing outer layers are contour cut to provide two widthwise channels traversing opposing upper and lower outer layers of the device. The channels, forming C-shaped clasps, universally contour and support an individual's thighs as well as the upper border of the knee joints by maintaining them in the normal anatomical position.

Several of the embodiments described herein incorporate three forms of orthopedic support cushions which are utilized on different regions. All three of these pillows are customizable via a tongue and groove attachment where the individual components of the support cushion can be either added to or subtracted from other components create the customization desired and necessary for the individual user.

The first alternate embodiment includes a cervical pillow, which is contoured by having two buttress of unequal dimension placed linearly at either end of the pillow. Vertically the pillow is made up three layers such that it's height can be customized to an individual physical and therapeutic needs. These layers are connected to one another via a tongue and groove locking mechanism which fastens the layers to one another in series.

This tongue and groove mechanism consists of a (mushroom like) male projection and negative impression, female conduit. The male projection comprises of a head which is connected to a shaft. The diameter of the shaft is somewhat narrower (and is positioned axially to the head) than the diameter of the head resulting in the lateral borders of the head protruding symmetrically laterally.

The female conduit is a negative impression of the male projection and is comprised of a head receiving area and stem receiving area.

In application, large individuals (larger 10% of population) would require all three layers in position in order to provide support for the natural curvature of their cervical spine. The average individual (average height and weight) would only require two layers and at the smaller end of the scale, slight individuals would only require a single layer of support.

These variances are broad spectrum, and additional consideration to choice of a specific number of layers would involve consideration of multiple other factors, e.g., whether the individual is predominantly a stomach or side sleeper, types of inherent deformity to the spinal curvature, and, most importantly the, individualized preference.

BRIEF DESCRIPTION OF DRAWINGS

Other objects and advantages of the invention will become apparent from the forgoing detailed description taken in connection with the accompanying drawings, in which.

DESCRIPTION OF THE PREFERRED EMBODIMENT

Figure 1:
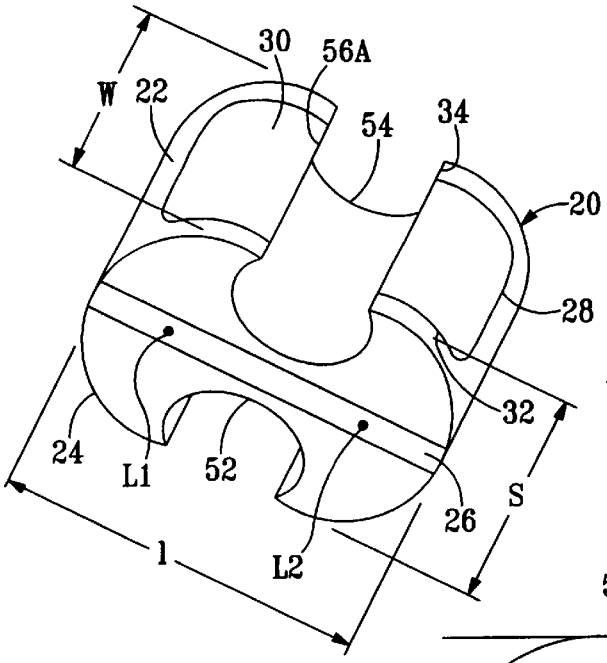
FIG. 1 is a perspective view of the side support pillow device of the present invention.
Figure 2:
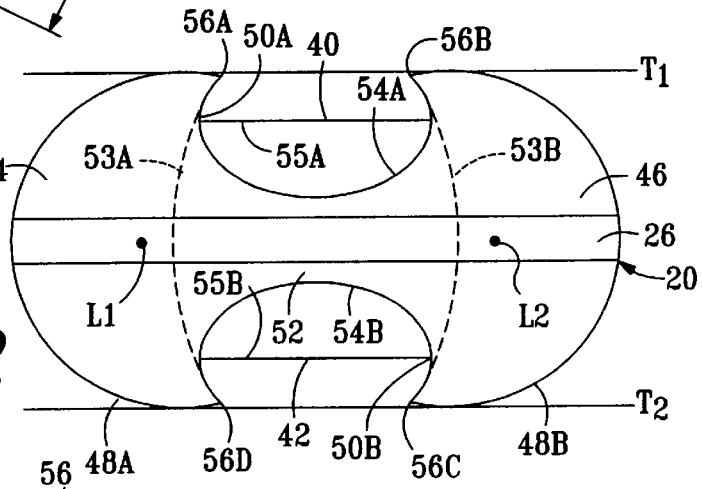
FIG. 2 is a side view of the side support pillow having top and bottom leg clasps.
Figure 3:
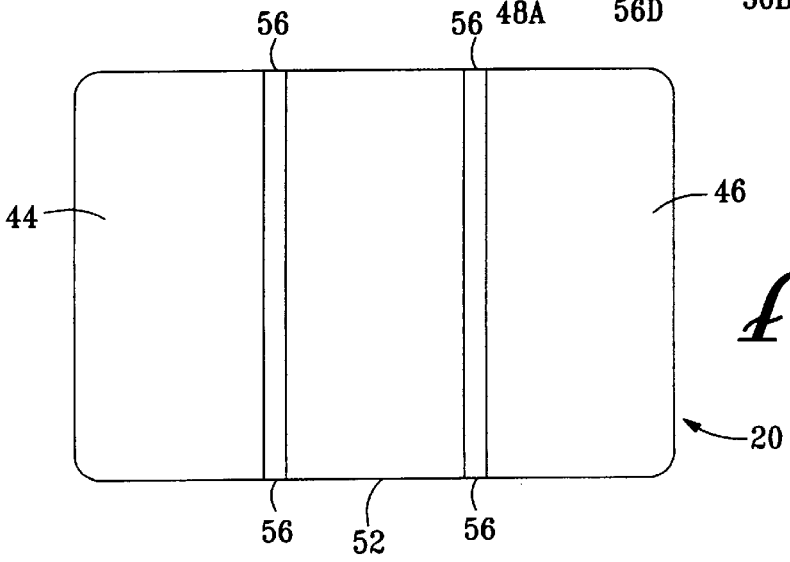
FIG. 3 is a top view of the side support pillow.
Figure 6:
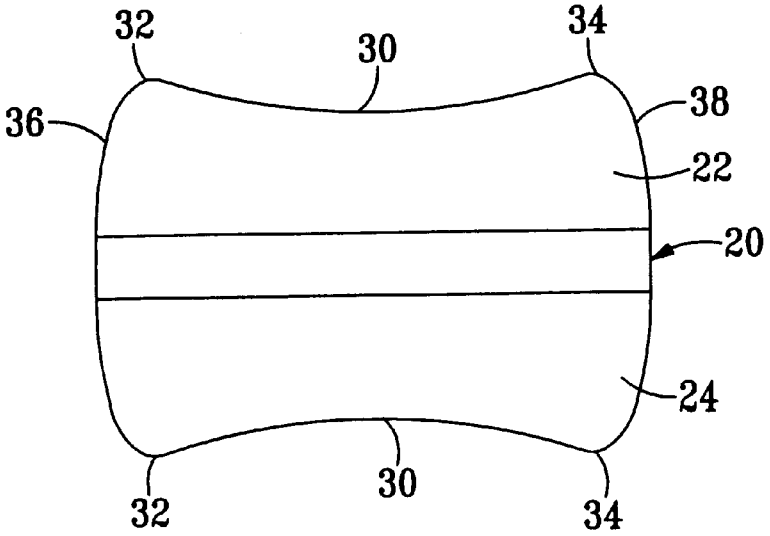
FIG. 6 is a front view of the side support pillow.

As shown in the drawings for purposes of illustration, the invention is generally embodied in a foam pillow 20, shown in FIGS. 1–3, comprised of two outer cushioning layers 22 and 24 of resilient foam material joined along inner surfaces 23,25 respectively to opposite surfaces of a high density foam mat 26. The outer surface 28 of each cushioning layer, generally rectangular in shape, from a top view as shown in FIG. 3 includes a concave shaped surface (FIGS. 1 and 6) forming a valley 30 bounded by side walls 32 and 34 rounded at respective peaks extending lengthwise dimension "l", as shown in FIG. 1 along the respective sides 36 and 38 of the pillow. Included within each cushion layer 22,24 (FIGS. 1–3) traversing the lengthwise median on opposite sides of the inner mat are opposing C-shaped channels 40 and 42 extending in a widthwise dimension "w", as shown in FIG. 1, forming outwardly-facing, leg clasps.

Thus, configured the pillow presents the appearance of two crescent-shaped buttresses 44 and 46, extending along the width wise dimension w and from top to bottom along a height dimension "h", as shown in FIG. 1 each formed with two outer convex surfaces 48A, 48B extending in a circular arc about an axis L1, L2 each of which extend through the inside of the pillow as shown in FIGS. 1 and 2. The C-shaped channels have four edges as shown at 56A, 56B, 56C, and 56D in FIGS. 1 and 2. Each of these four edges 56A, 56B, 56C and 56D are formed at the intersection of the two ends of the arcs of each of the two end surfaces 48A, 48B with the two ends of the arcs of each of the two channels 40, 42, at the ends of their inwardly facing surfaces 50A, 50B. The four edges 56A, 56B, 56C and 56D extend along the pillow in the width wise direction w, to form resilient fingers which perform a clasping function as described in greater detail below. A central stem 52, shown in FIG. 2 as lying within the region bounded by the dashed lines 53A, 53B and having convex-shaped iellipticaI arcs of curvature as shown at 54A, 54B, connects between the two crescent shaped buttresses and form the two surfaces 50A, 50B. The pillow, thus formed, when standing end-to-end is bi-laterally symmetric about the lengthwise plane formed by the central mat 26. The C-shaped channels each have an elliptical cross-sectional shape with the major axis of each channel 55A, 55B being parallel to the lengthwise median. The channels extend across the pillow in the width direction w, with one channel open to the top in the height dimension and one channel open to the bottom, as shown in FIG. 1. As also shown in FIGS. 1 and 2, the arc of curvature of each of the C-shaped channels is greater than 180°, extends along the width dimension and appears to be like the letter "C" rotated 90° so that one channel, 40 is open upward, and the other, opposed channel 42 is open downward. Each of the outer surfaces 48A, 48B has a cross-sectional shape of that of a portion of a circle, with the center of each circle in the median and defining an axis of rotation L1, L2. The outer surfaces 48A, 48B also extend across the pillow in the width direction w, have an arc of curvature greater than 180°, so that the arc of curvature of end 48A is open toward the interior of the pillow, i.e., to the right as shown in FIGS. 1 and 2, and the arc of curvature of end 48B is open toward the interior of the pillow, i.e., to the left as shown in FIGS. 1 and 2. In FIG. 2, a plane tangent to the tops of arcs of curvature of ends 48A, 48B, respectively is shown at T1, and a plane tangent to the bottoms of arcs of curvature 48A, 48B, respectively is shown at T2. By being greater than 180°, the arcs of curvature of the ends 48A, 48B extend beyond the points of tangency at which planes T1 and T2 are tangent to the uppermost and lowermost part of the arcs of curvature of ends 48A and 48B, and provide the structure of the resilient fingers for clasping the thighs of the user.

The central mat 26 provides a stiff center layer lengthwise through the center of the pillow 20, bounded on opposite sides by a comfortable outer layer 22 and 24 for contacting the legs of an individual. The foam pillow outer material 22 and 24 is preferably made from low density polyurethane foam of the type manufactured using conventional techniques for foam sleeping pillows. The inner layer or mat 26 is preferably made from high density polyurethane foam of the type manufactured using conventional techniques for foam gymnastic or camping floor mats. These layers may then be molded together using conventional glue or heat bonding techniques.

Figure 4:
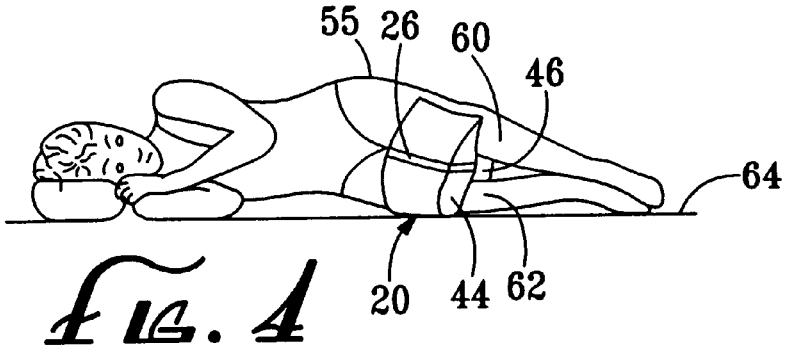
FIG. 4 is a perspective view of the side support pillow being used while an individual is in the side lying position with her thighs securely engaged within the respective clasps.
Figure 7:
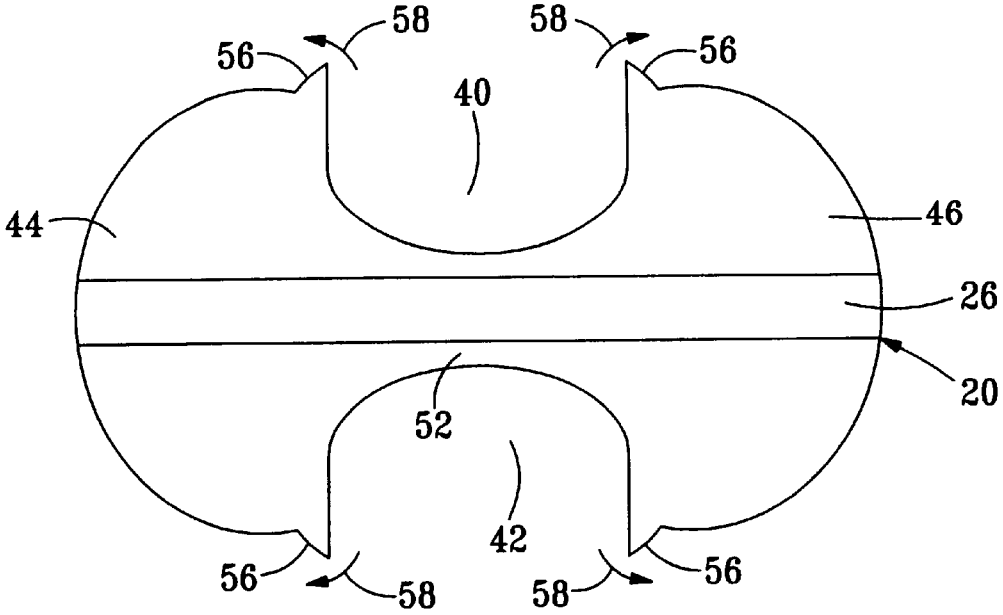
FIG. 7 is a side view of the side support pillow having top and bottom leg clasps forced apart for placement between the legs.

In use, the pillow 20 of the preferred embodiment can be used to reduce spinal stress while in the side lying and supine sleeping positions. When used for the side lying sleeping position (FIG. 4), the inner thighs 55 of an individual are placed within the respective clasps 40 and 42 of the pillow. Each clasp 40 and 42 includes deformable, resilient lips 56 (FIG. 7) which when forced to spread apart, as illustrated by force lines 58, provide an opening for receipt of an individual's thigh 55. The lips 56, when released return to their original position in engagement thereby hugging the respective thigh in a secure, universally-contoured engagement. The low density foam material securely maintains the pillow 20 between the thighs 55 throughout the sleep period by resisting disengagement from tossing and turning by the individual without any discomfort due to the containment of the thighs within the respective clasps. Once in place (FIG. 4), the crescent shaped buttresses 44 and 46 extend out from the front and back sides of the individual respectively. The bulk of the buttresses 44 and 46 supported by the rigidity of the inner mat 26 are of sufficient size and rigidity to resist the desire of the sleeping individual to roll over onto the prone or supine positions. The stem 52, secured between the thighs and further supported by the rigid compression resistant mat 26, produces a gap between the thighs 55, thereby resisting the natural tendency of the upper knee 60 to lie on top of the lower knee 62. The gap between the knee, preferably 2–4 inches, relieves the torsional stress on the spine created by the undesired rotation of the upper leg. Thus, the pillow 20 used in the side lying position, not only prevents rotation by the individual into an undesirable prone position, but also reduces spinal stress while in the side lying position by displacing the upper knee 60 in spaced apart relation to the lower knee 62.

Figure 5:
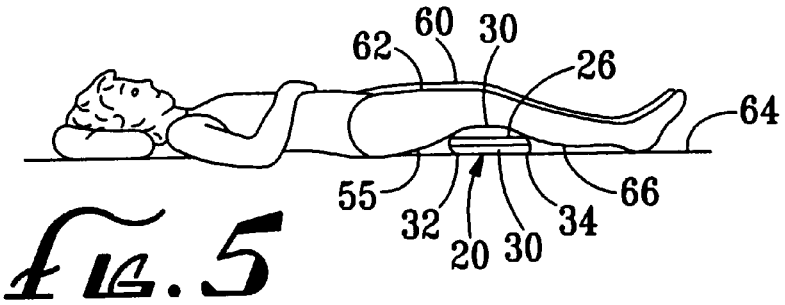
FIG. 5 is a perspective view of the side support pillow being used while an individual is lying in the supine position.

Similarly, when used for sleeping in the prone position (FIG. 5), the individual's legs extend traversely widthwise across one of the concave outer surfaces 30 of the pillow. The bulk of the pillow further enhanced by the compression resistant mat 26 causes the knees 60 and 62 to bend at an obtuse angle to accommodate the pillow 20 there under. With the knees bent, the lordotic curve of the spine is reduced or eliminated thereby allowing the lower spine to rest against the mattress or sleeping surface 64. Once again the outer layers 22 and 24 of the pillow compress and universally contour fit the shape of the individual's legs and underlying sleeping surface. Although compressed, the pillow does not uniformly support the back sides of the legs. Instead, the side walls 32 and 34 (FIGS. 5 and 6), created by the concave upper and lower surfaces having a stylized H-shape when viewed from an end, compress to a greater thickness than the middle valley portions 30 of the upper and lower surfaces 28. This non-uniform distribution of compression, ensures that bolstered knee is supported mainly by the backsides of the thigh 55 and calf 66. This reduces any direct pressure against the back of the knees 60 and 62 which is undesirable. Thus, the pillow 20 when used in the supine position reduces spinal stress by flattening out the spine, while supporting the knees 60 and 62 by the preferred backsides of the thigh 55 and calf 66 regions.

Figure 8:
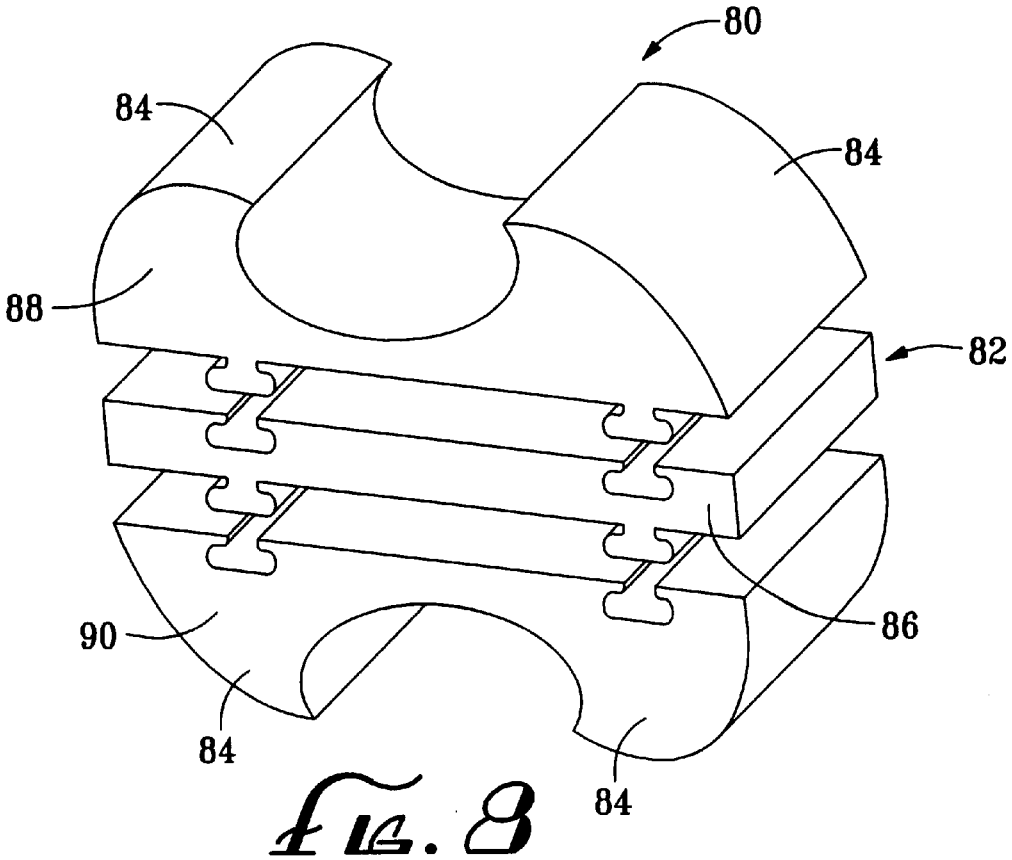
FIG. 8 is a perspective, exploded view taken from the front and to the side of an alternate embodiment showing a three layered, tongue and groove support pillow embodiment of the present invention.

With reference to FIG. 8, an alternate embodiment illustrates an effective and preferred structure and method of customization for a between-the-knee support device 80 which solves the problem of variation between various sizes and personal choice of individuals.

Ideally the body should rest in the natural anatomical position. The natural anatomical position as defined and pertaining to the lower limb is identified with the medial malleoli (ankles) separated by 7 inches and the medial condyles of the knees (inner border of the knee joint) separated by 4 inches. Variations from this norm creates abnormal strain on the femoral acetabular joint and the sacroiliac joints respectively.

The pillow of the present invention should be used in the side lying position where an individual can adjust the distance between opposing knees by either varying the thickness or density of the "stem" 82 thus maintaining the normal anatomical position. The diameter of the leg clasps should stay constant despite varying the diameter of the stem.

Increasing the diameter of the stem (for larger individuals) would also necessitate increasing the general height of the bumpers 84 in order provide enough rotational support to prevent the individual from rolling into the prone position while sleeping. This alteration in diameter of height of both the stem 82 and bumpers 84 can be attained by either adding or removing part of the material making up the product. This would allow the general shape of the product to maintained however the size (more specifically the height) would become variable. This would maintain the functionality of the product and yet allow customization for the individuals needs.

Adding and removing material to alter the general height of the product can be easiest attained by creating segments or layers, one of which is shown at 86. These layers whether added or removed would completely functional as different entities. Therefore the product is divided into two components. The upper and lower body contact regions and the functional components 88 and 90, respectively ("FC") and removable layers are the adjustable components ("AC") one of which is shown at 86.

An important feature is that the functional components 88, 90 act as solitary components regardless of the activity of the adjustable component(s) 86. Thus the FC 88, 90 must be connected by some structure, either directly or indirectly (interrupted by the AC) to the opposing FC. Various structures for creating this adhesion may be used, e.g., Velcro (hook and loop) fasteners, strapping, webbing and/or elastic fasteners. The preferred structure and method would employ the structure of the FC and AC so that they would connect to one another in series whether the AC is engaged or disengaged.

This preferred connection can be attained by providing either a singular or plurality of male projections and female conduits which would fasten the two FC's together, whether the FC's were either connected to one another directly, or indirectly connected through one or more of the AC's 86, thus allowing assembled support pillow to function as a solitary unit.

By connecting these components through a series of male projections and female layer 86, a high degree of customization is made possible with minimum additional structure and minimum to no loss of structural integrity of the pillow.

It is emphasized that the AC 86 can vary in number, as well as thickness of each layer 86. The principles of the present invention can also be used to provide various additional components to the cushion, e.g., different sized bumpers, various sizes for the leg clasps and so forth.

It will be appreciated by those skilled in the art, that a variety of sizes will be available to accommodate the diverse range of human forms. Such sizes will need to consider the size of the buttress in relation to the size and weight of the individual. In addition, the size of the leg clasps will need to adjust to variances in thigh diameter.

While the present invention has been described in connection with what are presently considered to be the most practical and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures.

What is claimed is:

1. A foam pillow having a length, a height and a width dimension comprising:

a first side wall extending along the length dimension and along the height dimension;

a second side wall extending along the length dimension and along the height dimension;

a first arcuate, C-shaped channel extending across the pillow in the width dimension from the first side wall to the second side wall and having an arc of curvature greater than 180°;

a second arcuate, C-shaped channel extending across the pillow in the width dimension from the first side wall to the second side wall, having an arc of curvature greater than 180° and positioned opposite the first C-shaped channel of the pillow;

a first arcuate end section extending across the pillow in the width dimension from the first side wall to the second side wall, having an arc of curvature greater than 180°, intersecting with the first C-shaped channel to form a first resilient edge extending across the pillow in the width dimension and intersecting with the second C-shaped channel to form a second resilient edge extending across the pillow in the width dimension; and a second arcuate end section positioned opposite the first end section, extending across the pillow in the width dimension from the first side wall to the second side wall, having an arc of curvature greater than 180°, intersecting with the first channel to form a third resilient edge extending across the pillow in the width dimension and intersecting with the second channel to form a fourth resilient edge extending across the pillow in the width dimension.

2. A foam pillow having a length, a height and a width dimension comprising:

a first side wall extending along the length dimension and along the height dimension;

a second side wall extending along the length dimension and along the height dimension;

a first arcuate, C-shaped channel extending across the pillow in the width dimension from the first side wall to the second side wall;

a second arcuate, C-shaped channel extending across the pillow in the width dimension from the first side wall to the second side wall and positioned opposite the first C-shaped channel of the pillow;

a first arcuate end section having an arc of curvature defined by a single constant radius extending across the pillow in the width dimension from the first side wall to the second side wall, intersecting with the first C-shaped channel to form a first resilient edge extending across the pillow in the width dimension and intersecting with the second C-shaped channel to form a second resilient edge extending across the pillow in the width dimension;

a second arcuate end section having an arc of curvature defined by a single constant radius positioned opposite the first end section, extending across the pillow in the width dimension from the first side wall to the second side wall, intersecting with the first channel to form a third resilient edge extending across the pillow in the width dimension and intersecting with the second channel to form a fourth resilient edge extending across the pillow in the width dimension;

the first resilient edge and the third resilient edge formed along the arc of curvature of the first end section beyond the points of tangency of a first plane tangent to the arc of curvature of the-first end section and to the arc of curvature of the second end section; and the second resilient edge and the fourth resilient edge formed along the arc of curvature of the first end section beyond the points of tangency of a second plane tangent to the arc of curvature of the first end section and to the arc of curvature of the second end section on the opposite side of said pillow.

* * * * *